United States Patent [19]

Chalke

[11] Patent Number: 4,641,612

[45] Date of Patent: Feb. 10, 1987

[54] ELECTRIC STARTING AID FOR AN INTERNAL COMBUSTION ENGINE

[75] Inventor: Brian J. Chalke, Feltham, England

[73] Assignee: Lucas Industries public limited company, Birmingham, England

[21] Appl. No.: 751,480

[22] Filed: Jul. 3, 1985

Related U.S. Application Data

[63] Continuation of Ser. No. 545,634, Oct. 26, 1983, abandoned.

[30] Foreign Application Priority Data

Nov. 9, 1982 [GB] United Kingdom ..... 8231946

[51] Int. Cl.[4] ..... F02N 17/04

[52] U.S. Cl. ..... 123/145 A; 123/179 H

[58] Field of Search ..... 123/179 H, 179 G, 145 A, 123/543, 557, 558

[56] References Cited

U.S. PATENT DOCUMENTS

| | | | |
|---|---|---|---|
| 3,400,699 | 9/1968 | van Kirk et al. | 123/179 H |
| 4,202,308 | 5/1980 | Skinner | 123/179 H |
| 4,325,345 | 4/1982 | Wilkinson et al. | 123/557 |
| 4,368,715 | 1/1983 | Molewyk et al. | 123/179 H |
| 4,380,218 | 4/1983 | Munro | 123/179 H |
| 4,426,962 | 1/1984 | Otani et al. | 123/179 H |

FOREIGN PATENT DOCUMENTS

| | | | |
|---|---|---|---|
| 1207147 | 12/1965 | Fed. Rep. of Germany | 123/179 H |
| 2030214 | 4/1980 | United Kingdom | 123/179 H |

*Primary Examiner*—Parshotam S. Lall

[57] ABSTRACT

An electric starting aid for an internal combustion engine includes a body and a stem extending from the body. The stem contains a temperature responsive valve which when heated allows fuel flow from an inlet into the peripheral surface of the stem. A heating element is tightly wound about the stem and has one end secured to the stem and the other end to a terminal. An ignition element extends in spaced relationship about the stem and has one end secured to the stem and the other end to the body. The stem is electrically insulated from the body.

3 Claims, 2 Drawing Figures

ELECTRIC STARTING AID FOR AN INTERNAL COMBUSTION ENGINE

Figure 1:
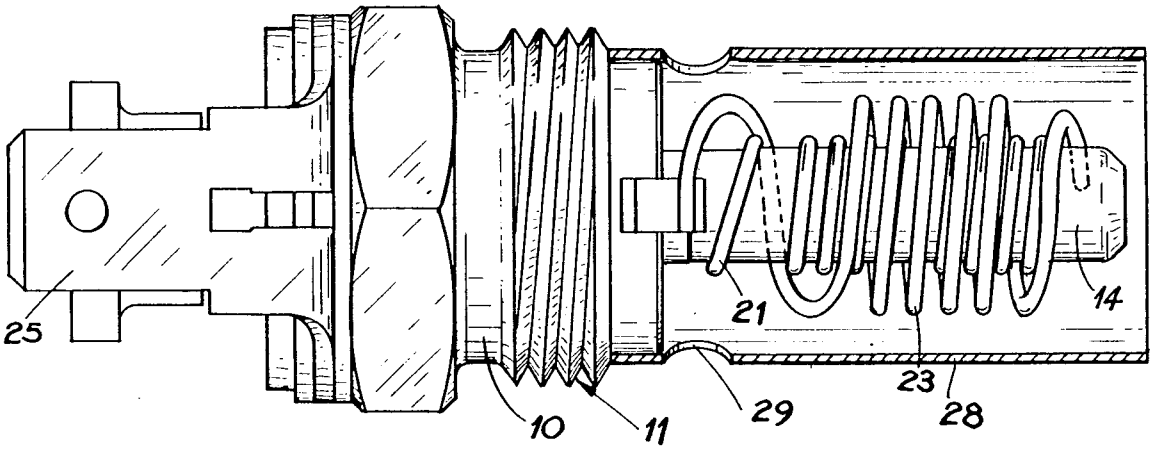

This application is a continuation, of application Ser. No. 545,634, filed Oct. 26, 1983 now abandoned.

This invention relates to an electric starting aid for an internal combustion engine, the aid being of the type having a body defining a fuel inlet, a hollow stem extending from the body, a temperature responsive valve located in the stem, said valve when said stem has attained a sufficiently high temperature, opening to permit fuel flow to an outlet defined in the stem, an electric heating element which when energised heats the stem to actuate the valve and also raises the temperature of the stem to a value sufficient to cause vapourisation of the fuel leaving the opening and an electric ignition element acting in use to ignite the vapourised fuel in the region of the stem.

Such aids are well known in the art and it is known to connect the two elements in series with the elements being formed from tape or wire wound in helical fashion. The usual practice is to dispose the elements in axial relationship with the ignition element being largely self supporting, the ignition element at one end being connected to a casing forming part of the aid. The opposite end of the ignition element is connected to or may be continuous with the one end of the heating element, the other end of which is connected to an electric terminal. Without an intermediate support there is no tension in the heating element which means that it has poor thermal contact with the stem and in the use of the associated engine, can vibrate with the possible risk of damage to electrical insulation provided between the element and the stem. It is desirable in some cases to have the elements mounted in overlapping but spaced relationship and with this construction the same problem can arise.

It is an object of the invention to provide a starting aid of the kind specified in an improved form.

According to the invention in a starting aid of the kind specified said hollow stem is electrically insulated from the body, and said heating element is tightly wound about the stem, the end of the heating element remote from the body being secured to the stem and the opposite end of the heating element being secured to a terminal member carried by the body, one end of said ignition element being secured to said stem at its end remote from the body and the other end of the ignition element being connected to a further terminal member.

Accordingly to another aspect of the invention a method of making a starting aid of the kind specified comprises the steps of forming the body with the fuel inlet, providing an insulated coating on the stem and mounting the stem on the body so that the stem is electrically insulated from the body, securing an end of a length of material which is to form the heating element to the end of the stem remote from the body or to a terminal member carried by the body, winding the length of material tightly about the stem to form the heating element and securing the end of the length of material to either said terminal member or said stem, and locating said ignition element in position and securing one end thereof to the end of the stem remote from the body and the other end to a further terminal member.

An example of a starting said in accordance with the invention will now be described with reference to the accompanying drawings, in which:FIG.

Figure 2:
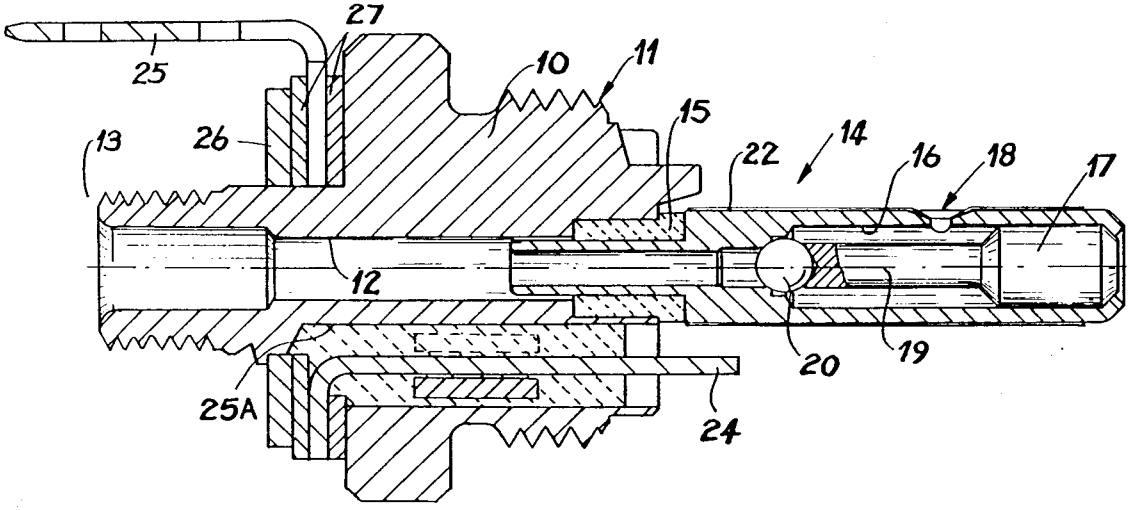

FIG. 1 is a side view of the aid with part of the aid sectioned to reveal the interior of the aid; and FIG. 2 is a sectional side elevation of part of the aid seen in FIG. 1.

Referring to the drawings, the starting aid comprises a body 10 having a screw-threaded portion 11 whereby the aid can be mounted in a suitable threaded aperture in an inlet manifold of a compression ignition internal combustion engine. To facilitate tightening of the body the latter is provided with a hexagonal portion. In addition, the body has an axially extending bore 12 which extends to a fuel inlet 13. The inelt in use, is connected by means of a pipeline to a source of fuel.

Extending from the body is a stem generally indicated at 14, the stem having a reduced diameter portion which extends into the bore 12 but which is spaced therefrom. The stem is formed from metal and is of hollow form. The stem is secured in the body using a fused glass insert 15 which also acts to electrically insulate the stem from the body. The bore 16 within the stem is of stepped form and the end of the bore remote from the body is closed by a plug 17 which conveniently is secured within the stem by spot welds not shown, the end of the stem is deformed over the plug to provide a fuel tight seal.

An aperture 18 is formed in the wall of the stem, the aperture extending from the enlarged portion of the bore and extending within this portion of the bore and integrally formed with the plug 17 is a rod 19 which at its end remote from the plug, is provided with a recess of conical form. Located by the recess is a valve member in the form of a ball 20 and which is urged into contact with a seating defined by a step in the bore. The materials forming the stem and the rod 19 have differing coefficients of expansion so that when the stem 14 is heated as will be explained, the stem expands to a geater degree than the rod 19 thereby allowing the ball 20 to be urged from the seating by the action of the fuel under pressure supplied to the inlet 13. When this occurs the fuel flows to the outlet 18 but since the stem is heated, the fuel will be vapourized.

Surrounding the stem in heat exchange relationship therewith, is a heating element 21. This is of helical form and is tightly wound about the stem. The heating element is insulated from the stem by means of an electrically insulating coating 22 which is applied to the stem preferably before the stem is assembled to the body. The end of the heating element remote from the body is secured as by welding, to the stem and the other end of the heating element is electrically connected to a terminal member defined by the body.

Surrounding the heating element in spaced relationship is an electric ignition element 23 which is of helical form and the end of the ignition element remote from the body is secured to the stem as by welding. The other end of the ignition element is connected to a terminal member 24 which extends through a drilling 25A in the body and is supported within the drilling by glass insulation material. The terminal member 24 is integral with a connector blade 25 which in use is connected to a source of electric supply. The terminal member and blade are mounted on the body and secured by means of a washer 26 which is held in position by deforming a portion of the body. Insulating washers 27 are disposed on opposite sides of the connector to provide the necessary insulation.

A tubular shield 28 surrounds the stem and the aforesaid elements in spaced relationship and it is secured about a cylindrical portion of the body. The shield is provided with apertures 29 through which air can enter the enclosed space surrounding the stem.

In use, when the connector is connected to an electric supply, the other terminal of the supply being connected to the body, the heating element and ignition element become heated. The heating element heats the stem to allow fuel flow through the aperture 18 as described and the air/fuel mixture which accumulates in the space around the stem is ignited so that a flame is produced. The flame as is well known heats the air flowing to the engine to facilitate starting thereof.

The stem thus constitutes a mounting for the connection between the heating and ignition elements thereby the heating element is held tightly about the stem so that there is good heat exchange relationship between the element and the stem.

In constructing the starting aid, it is convenient to mount the stem in the body and then to locate the body and stem in a winding machine for the purpose of winding the heating element. The ends of the heating element may be secured by brazing if so desired. The ignition element is conveniently wound about a hollow collapsible mandrel which is located about the heating element and when the ends of the ignition element have been connected as described, the mandrel is collapsed and withdrawn leaving the ignition element located in spaced relationship about the heating element. The shield is then secured in position.

What is claimed is:

1. An electric starting aid for an internal combustion engine of the kind having a body defining a fuel inlet, a hollow electrically conductive stem extending from the body, a temperature responsive valve located in the stem, said valve when said stem has attained a sufficiently high temperature, opening to permit fuel flow to an outlet defined in the stem, an electric heating element which when energised heats the stem to actuate the valve and also raises the temperature of the stem to a value sufficient to cause vapourisation of the fuel leaving the opening and an electric ignition element acting in use to ignite the vapourised fuel in the region of the stem, securing means for electrically securing one end of said electric heating element to said stem for supporting said electric heating element at said one end and holding said electric heating element tightly about said stem, electrical connection means for electrically connecting another end of said electric heating element to said body, means for electrically securing one end of said electric ignition element to said stem, electric terminal means for electrically connecting another end of said electric ignition element to one terminal of a source of electric power, means connecting said body to another terminal of said source of electric power whereby said electric heating element and said electric ignition element are in series and each has one end thereof electrically secured to said stem, electrical insulating means interposed between said stem and said body, said electric heating element being tightly wound around said stem with said securing means maintaining the tight winding of said electric heating means.

2. A starting aid according to claim 1 in which said electrical insulating means includes fused glass insert providing electrical insulation from the body.

3. A method of making an electric starting aid for an internal combustion engine, the aid being of the type having a body defining a fuel inlet, a hollow stem extending from the body, a temperature responsive valve located in the stem, said valve when said stem has attained a sufficiently high temperature, opening to permit fuel flow to an outlet defined in the stem, an electric heating element which when energised heats the stem to actuate the valve and also raises the temperature of the stem to a value sufficient to cause vapourisation of the fuel leaving the opening and an electric ignition element acting in use to ignite the vaporised fuel in the region of the stem, the method comprising the steps of forming the body with the fuel inlet, providing an insulating coating on the stem and mounting the stem on the body so that the stem is electrically insulated from the body, securing an end of a length of material which is to form the heating element to the end of the stem remote from the body, winding the length of material tightly about the stem to form the heating element and securing the end of the length of material to said stem, and locating said ignition element in position and securing one end thereof to the end of the stem remote from the body to be in electrical series with said heating element and the other end thereof to a further terminal member.

* * * * *